United States Patent [19]

Mizandjian et al.

[11] Patent Number: 4,870,801

[45] Date of Patent: Oct. 3, 1989

[54] PROCESS AND APPARATUS FOR MAKING AN INERT ATMOSPHERE IN AIRTIGHT PACKAGES

[75] Inventors: Jean-Luc Mizandjian, Igny; Jean-Louis Pean, Montlheri; Jean Amen, Versailles, all of France

[73] Assignee: L'Air Liquide, Paris, France

[21] Appl. No.: 253,434

[22] PCT Filed: Apr. 23, 1986

[86] PCT No.: PCT/FR86/00139

§ 371 Date: Dec. 10, 1986

§ 102(e) Date: Dec. 10, 1986

[87] PCT Pub. No.: WO86/06347

PCT Pub. Date: Nov. 6, 1986

Related U.S. Application Data

[63] Continuation of Ser. No. 2,757, Dec. 10, 1986, abandoned.

[30] Foreign Application Priority Data

Apr. 29, 1985 [FR] France ..... 8506479

[51] Int. Cl.[4] ..... B65B 31/04

[52] U.S. Cl. ..... 53/432; 53/510

[58] Field of Search ..... 53/426, 432, 88, 110, 53/167, 510

[56] References Cited

U.S. PATENT DOCUMENTS

| | | | |
|---|---|---|---|
| 3,477,192 | 11/1969 | Brown | 53/432 |
| 3,566,575 | 3/1971 | Lisiecki | 53/426 |
| 4,140,159 | 2/1979 | Domke | 53/526 |

*Primary Examiner*—John Sipos

[57] ABSTRACT

The process, applied to inerting of airtight packagings, used together or separately the deoxygenation of empty packagings under inert atmosphere, purging of the gas ceiling of the packagings after filling and before closing with an inert fluid, under inert atmospheres, each operation being performed by two simultaneous injections of fluid; said liquid or pasty product optionally being deoxygenated by an inert gas. This technique is applicable to the preservation of any liquid, pasty, solid and powdery food product, to pharmaceutical and biological products.

2 Claims, 3 Drawing Sheets

1
2
3
4
5
6
7
8
9a
9b
9c
9d
10a
10b

PROCESS AND APPARATUS FOR MAKING AN INERT ATMOSPHERE IN AIRTIGHT PACKAGES

This application is a continuation, of application Ser. No. 002,757, filed Dec. 10, 1986 now abandoned.

FIELD OF THE INVENTION

This invention relates to a process of inerting airtight packagings for liquid, pasty, solid and pulverulent products; and an installation for using it.

BACKGROUND OF INVENTION

Liquid, pasty or solid food products in contact with the ambient air are subject to numerous risks of biochemical or microbiological changes which are reflected by darkening, loss of taste, even of vitamins, disagreeable tastes, etc. These degradations, consequences of the presence of oxygen, are a function of the time of contact between the product and ambient air.

If these degradation phenomena are rather well controlled today, during production of the products up to the bulk storage, the risks of changes which appear during or after packaging of the finished products are still not completely eliminated; this is essentially due to difficulty of control of the parameters of handling and storing of liquid or pasty products.

To limit the risks of degradation of food products and thereby to increase the preservation period, it is essential to avoid the presence of oxygen in the product in the form of dissolved oxygen, and in its packaging in the form of gaseous oxygen. The use of an inerting technique thus seems well suited to packaging of food products.

If the present techniques of deoxygenation of food liquids by nitrogen bubbling or placing under vacuum considerably reduce the dissolved oxygen concentration, they prove insufficient at times. Actually, the action of the oxygen present in the gaseous medium is considerable and can cause degradation of products sensitive to oxidations, in particular during prolonged storage periods, particularly in the case of products intended for export.

Inerting of a packaged pasty, liquid or solid product requires elimination of the oxygen contained in the gaseous medium of the airtight packaging and of oxygen possibly dissolved before or after filling.

SUMMARY OF INVENTION

Research has been conducted to find a process making it possible, after packaging, to limit to less than 2% the residual oxygen content in the gaseous medium of the packaging: it is essential to attain this result to guarantee the absence of degradation of the food product.

The objective set, corresponding to residual gaseous oxygen content below 2%, is very difficult to attain on industrial packaging equipment.

A process has been found whose inerting effectiveness on industrial packaging equipment is excellent and responds to the requirement of a residual gaseous oxygen content below 2% in the packaging medium.

According to this process using together or separately a deoxygenation of the empty packagings in a packaging zone, and a deoxygenation of the packagings after filling, each of these deoxygenations is performed under inert atmosphere by means of two simultaneous injections of inert fluid. The deoxygenation or purging of the empty or filled packagings is performed by means of a network for distribution of said fluid with vertical injection of the fluid in the top part of the packaging, directed toward the bottom of the packaging, and the inert atmosphere is created by injection of the inert fluid distributed above the packagings.

DETAILED DESCRIPTION OF EMBODIMENTS

The packagings can be subjected to a double gas purging before filling and after filling.

Depending on the nature of the product to be packaged, it is possible to proceed to a deoxygenation of the package by an inert gas, followed by a phase of decanting of the gas bubbles.

The fluids, liquids or gases used for deoxygenation of the product to be packaged or inerted are designated as inert gases, i.e. fluids whose action opposes biochemical or microbiological alterations caused by oxygen.

The inert fluid can be nitrogen in gaseous or liquid form, which is inert and intervenes by anaerobic conditions which it creates in regard to microbial species. It is also possible to use with advantage a bacteriostatic gas with an inhibiting effect against numerous microorganisms, such as carbon dioxide ($C0_2$), or a nitrogen-carbon dioxide mixture.

The process of inerting airtight packagings can be used in an installation consisting of a packaging machine comprising a section for shaping of the packagings, a section for filling and a section for closing of the packagings, a feed circuit, the machine being fed the product to be packaged.

Figures 1, 2, 3:
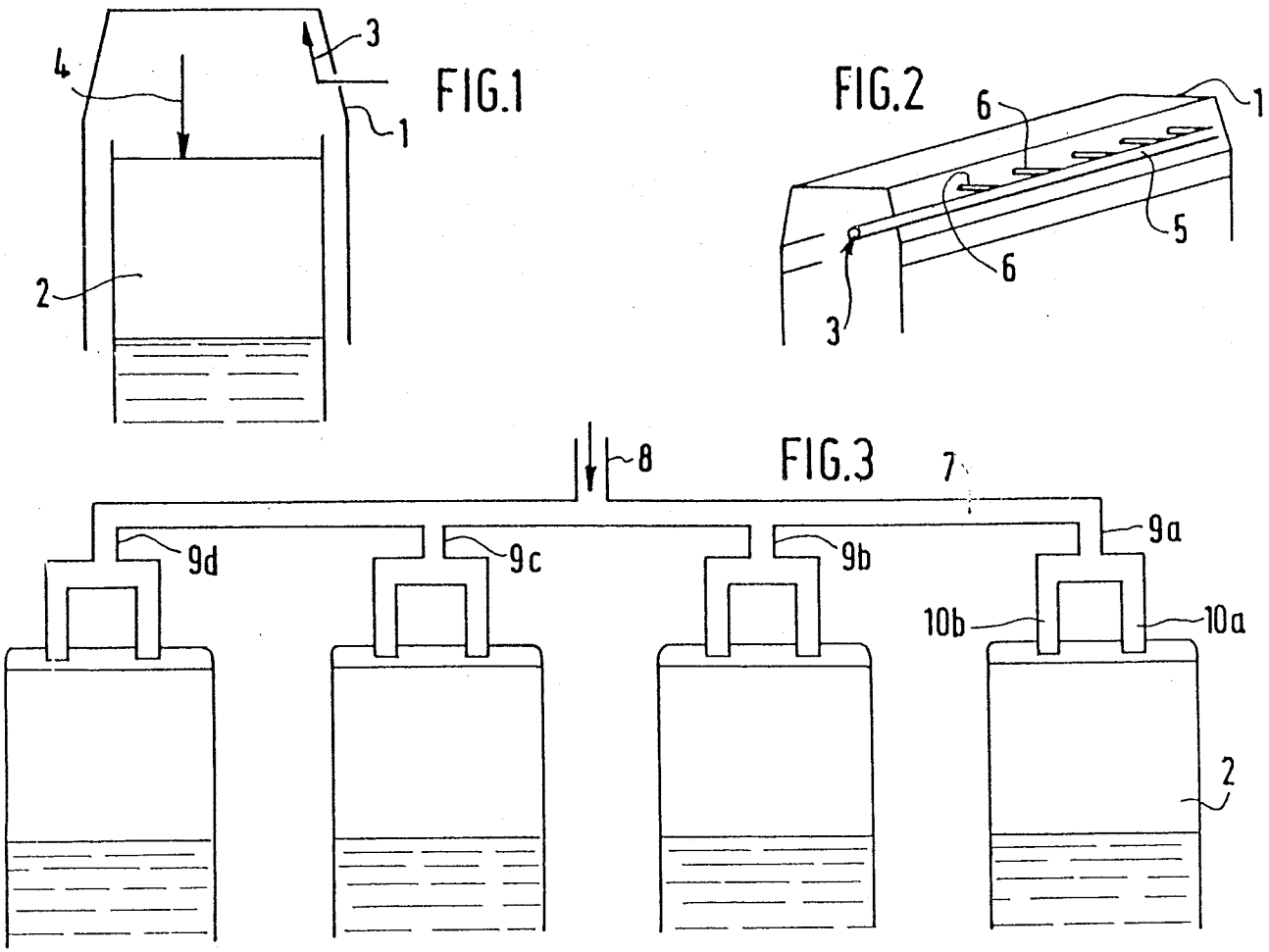
FIG. 1 is a schematic cross-sectional view of an inerting device according to the invention.
FIG. 2 is a schematic perspective view of a purging and inerting device.
FIG. 3 is a schematic cross-section of a distribution network.

The inerting device, installed on the packaging machine, comprises according to FIG. 1 of the accompanying drawing, an insulating cap (1), necessary for protecting the packaging (2) from any entry of oxygen, an inerting fluid feed circuit (3) and a purging fluid feed circuit for each packaging (4).

Inerting and purging of cap (1) are performed by a gas distribution network of the inert gas placed laterally and located above the packagings, i.e., in the upper part. This purging and inerting system shown in FIG. 2 of the accompanying drawing is formed by a distributor (5) provided with injectors (6) in the form of horizontally aligned cylindrical tubes whose output orifices face upwardly from protective cap (1) so as to avoid any disturbances of the system of later purging of the upper spaces or the high part of the packagings after filling.

The inerting device further comprises a gas distribution network (7) of the gas coming from input (8) for the gas purging of the upper part or high part of the packagings. This distribution network or distributor (7), represented in FIG. 3 of the accompanying drawing, is placed immediately above the central axis of the packagings (2) with injection means (*9a, 9b, 9c, 9d* . . .) directed downward, aligned, and each formed of one or more cylindrical tubes 10*a*, 10*b*, optionally flattened at the end assuring an effective purging of the gaseous medium.

These devices make it possible to obtain a very effective inerting essentially due to the limitations of air intakes and disturbances by side currents; to the use of cylindrical tubes whose purging effect proves to be more high-performing than that of the nozzles. The normal operating conditions of the gas output, very close to laminar operating conditions, reduces the possibilities of air entrainment. The double system of purging the gaseous medium of the packagings works with the effectiveness of the inerting.

Figure 5:
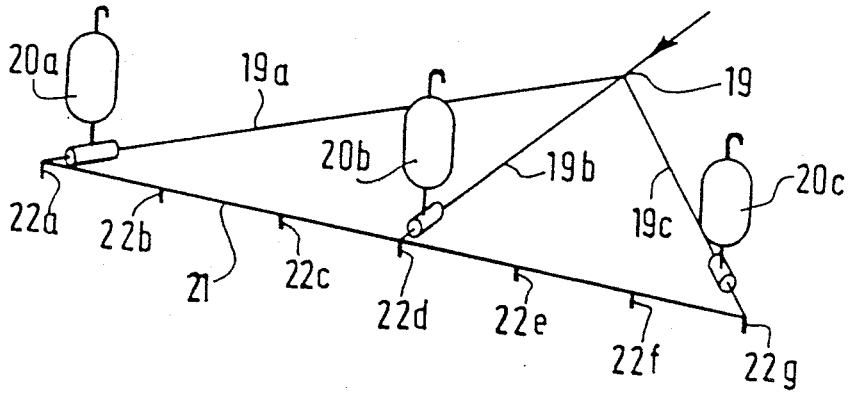
FIG. 5 shows a variant of a distribution network according to the invention.

According to another variant, the inerting device comprises a liquid nitrogen distribution network for purging of the packagings. This distribution network or injection distributor of liquid nitrogen shown in FIG. 5 of the accompanying drawing comprises a liquid nitrogen feed pipe (19) optionally divisible into several different circuits (19*a*, 19*b*, 19*c*...) provided with a purger (20*a*, 20*b*, 20*c*) to avoid the formation of gas in the pipe or distributor (21) in which said circuits come out, said distributor being located above the packaging lines and provided with injection means (22*a*, 22*b* . . . 22*f*, 22*g*) placed immediately above the central axis of the packagings.

The cold gas coming from vaporization of liquid nitrogen then purges the air present in the container. It is advisable in this case to assure the total vaporization of the liquid nitrogen before plugging of the container, to avoid any excess pressurizing of flexible packagings.

It is possible advantageously to place at the insulating cap, above liquid nitrogen injection system described above, provided with a gas distribution network assuring an inert atmosphere around packagings as described above.

The devices for inerting of packagings according to the invention can be installed on the packaging line between the section for shaping of the packagings and filling section, to assure filling of the packaging in an inert atmosphere and to avoid any oxygenation of the product during its flow, or before closing of the filled packagings to inert the gaseous medium of the packaging and thus to improve the preservation of the product. These two operations can be performed together if necessary.

Figure 4:
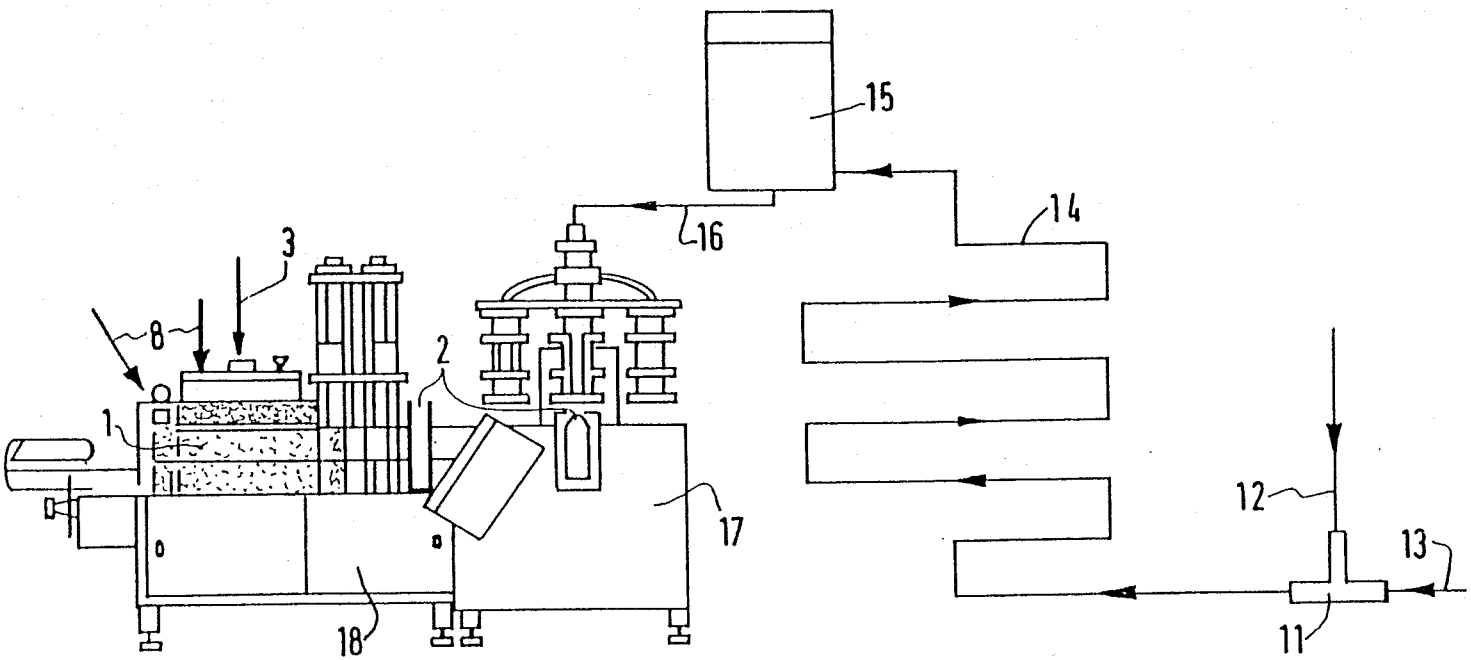
FIG. 4 shows a feed circuit.

The feed circuit of the packaging machine, represented in FIG. 4 of the accompanying drawing, comprises a gas injection means (11) of the injector type placed on pipe (13) and (14) of the liquid or paste and a buffer tank (15) placed on the packaging device permits decanting of bubbles. An ejector (venturi), another gas injection means, can also be used on pipe (14) of the liquid or paste and placed at the bottom of buffer tank (15).

These inerting techniques can be applied to preserving any liquid or pasty food product: beers, wines, fruit juices, beverages with a base of fruit juice, concentrates and syrups, milk and milk products, oils and derivatives, lipidic products (sauces and mayonnaise). They are also applicable to pharmaceutical and biological products. In the case of beers, the inerting sequence comprises two stages, according to which one proceeds to the protection of the packagings from any entry of oxygen and to the creation of an atmosphere free of oxygen in the packaging zone before closing them by an inert gas, then to a gas purging of the gaseous medium of the packagings after filling by a gas distribution network.

Further, the technique described above is applicable to the preservation to any solid or powdery product.

There is given by way of nonlimiting example in FIG. 4 of the accompanying drawing, the diagram of an example of application, particularly in inerting a wine production line.

The clarified wine is conveyed in pipe (12) to the "Sparger" type injector (11) and the nitrogen is introduced by pipe (13) into said injector. The deoxygenated wine is routed by conduit (14) to the low part of buffer tank (15) in which the bubbles are decanted, the degassed wine is drawn off by conduit (16) at the base of tank (15) and goes into filling section (17) of the packager. Closing section (18) of the packager comprises insulating cap (1) previously described, a nitrogen intake (3) for purging and inerting the gas chamber, and a nitrogen-carbon dioxide mixture intake (8) for purging the gaseous medium of the packagings.

Red wine is packaged at 11°, at a temperature of 22° C., at a rate of 2 $m^3$/hour. The packaging device is suited to packagings with the following characteristics: 7×7×25 cm, volume of filling ve=1 liter, volume of gaseous medium to purge vh=0.3 liter, immobility of the packaging t=1.4 s.

The installation made comprises particularly an insulating cap through which the packages are continuously passed with length of 630 mm, width of 270 mm and height about 300 mm; an inerting distributor of this insulating cap of the inerting device, comprising five inert gas injection tubes made of stainless steel 8-10, the distance between two injection tubes being 100 mm; and a purging distributor of packagings after filling, 334 mm long, comprising four double injections, consisting of stainless steel tubes 6-8, the distance between 2 injections being 110 mm. Each injection is double, consisting of two stainless steel tubes 6 mm in diameter, flattened at their end and spaced 20 mm.

Before packaging, the wine contains 1.2 ppm of dissolved oxygen, 1.8 $m^3$/hour of nitrogen is injected in the clarified wine. After this packaging, the content in dissolved oxygen of the wine is 0.6 to 0.7 ppm.

Inerting of the cap of the inerting device is realized by injection of nitrogen, and gas purging of the packagings and closing with an inert gas consisting of 50% nitrogen, 50% carbon dioxide.

Analytic checking of the gaseous medium of the packagings after packaging was made of 200 packages. The results obtained in the form of average values for this amount of packagings are given in the following table as well as the volumes of nitrogen in $m^3$/h used for inerting the cap of the packager and the volumes in $m^3$/h of the inert mixture of 50% $N_2$–50% $CO_2$. Inerting of cap Purging of packaging Gaseous medium

| Inerting of cap | | Purging of packaging | | Gaseous Medium (200 packagings) | |
|---|---|---|---|---|---|
| $N_2$ | $m^3$/h | 50 $N_2$ | 50 $CO_2$ $m^3$/h | $O_2$ | $CO_2$ |
| | 4.5 | | 3.6 | 1.6 | 25.5 |
| | 4.5 | | 5.1 | 0.9 | 26.5 |
| | 4.5 | | 5.4 | 0.7 | 23.5 |
| | 4.5 | | 5.4 | 0.5 | 27 |

The fourth test was made with injection above the packagings and at the beginning of closing and checking was made after 16 hours.

It was found that the technique used makes it possible to lower the oxygen content in the gaseous medium of the packaging to values less than 2%. It was noted that injection of a gaseous $N_2/CO_2$ mixture causes a slight shrinking of the packaging.

I claim:

1. A process of inerting an airtight package containing a consumable product, comprising passing the package, while open and containing the consumable product, into and through an elongated insulating gap for protecting the open package from entry thereinto of oxygen, the transverse width of said cap having a dimension only slightly greater than the transverse dimension of the packages and extending downwardly a substantial proportion of the height of said packages;

feeding inert gas into the interior of said elongated insulating cap above the level of the top of the package in a direction which is at first horizontal and then upwards in the interior of the insulating cap to flush the atmosphere above the package downwardly through spaces between packages and lateral walls of the cap;

simultaneously and separately feeding inert gas downwardly through a vertical tubes into said package to purge gaseous medium therefrom; and sealing said package.

2. A process for inerting an open package containing a consumable product and sealing said package in an airtight manner, comprising:

passing an upper end of the open package containing the consumable product into and through an elongated insulating cap having a generally inverted U-shaped cross-section with an open bottom and side walls extending downwardly a substantial portion of the height of said package, the transverse width of said elongated insulating cap having a dimension only slightly greater than the traverse dimension of the package;

feeding inert gas into the interior of said elongated insulating cap above the level of the upper end of the package in a direction which is at first horizontal and then upwards within the insulating cap to flush the atmosphere above the package downwardly through spaces between the package and the lateral walls of the insulating cap, to prevent entry of oxygen into said insulating cap while said package is moving therethrough;

simultaneously and separately feeding inert gas downwardly through vertical tubes into said package to purge gaseous medium therefrom while said package is moving through said elongated insulating cap; and sealing said open package to provide an airtight package.

* * * * *